US007290929B2

(12) United States Patent
Smith et al.

(10) Patent No.: US 7,290,929 B2
(45) Date of Patent: Nov. 6, 2007

(54) MOUNTING SYSTEM FOR AN X-RAY TUBE

(75) Inventors: Craig Smith, Herriman, UT (US); Christopher Artig, Summit Park, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/774,899

(22) Filed: Feb. 9, 2004

(65) Prior Publication Data

US 2005/0175150 A1 Aug. 11, 2005

(51) Int. Cl.
*H05G 1/02* (2006.01)
*H01J 35/16* (2006.01)
*H01J 35/18* (2006.01)

(52) U.S. Cl. ..... 378/193; 378/121; 378/140; 378/161

(58) Field of Classification Search ..... 378/119, 378/121, 140, 141, 142, 147, 161, 193, 197, 378/199–203, 123; 248/74.1, 74.4, 222.41, 248/225.11, 346.03
See application file for complete search history.

(56) References Cited

U.S. PATENT DOCUMENTS 2,216,887 A * 10/1940 Machlett ..... 378/125
2,344,543 A * 3/1944 Findlay ..... 378/161
3,992,633 A * 11/1976 Braun et al. ..... 378/2
4,107,562 A * 8/1978 Koller et al. ..... 378/203
4,157,476 A * 6/1979 O'Connor ..... 378/203
4,260,891 A * 4/1981 Williams ..... 250/385.1
4,893,321 A * 1/1990 Eitner et al. ..... 378/121
4,946,122 A * 8/1990 Ramsey et al. ..... 248/229.2
5,303,283 A * 4/1994 Jedlitschka et al. ..... 378/202
5,492,780 A * 2/1996 Okada ..... 429/121
6,134,299 A * 10/2000 Artig ..... 378/121
6,155,889 A * 12/2000 Scarla et al. ..... 439/774
6,644,853 B1 * 11/2003 Kantor et al. ..... 378/203

* cited by examiner

*Primary Examiner*—Allen C. Ho
(74) *Attorney, Agent, or Firm*—Workman Nydegger

(57) ABSTRACT

A mounting assembly for supporting an evacuated enclosure within an outer housing of an x-ray tube is disclosed. The mounting assembly comprises a clamp portion having a C-shaped configuration, and a bracket portion having a circular recess that receives at least a portion of the clamp portion therein. The clamp portion includes an aperture that frictionally attaches to a window assembly of the evacuated enclosure. The clamp portion is in turn mechanically attached to the bracket portion such that an aperture in the bracket portion is aligned both with the clamp portion aperture and a window disposed in the window assembly. The bracket portion further includes a concave surface that is shaped to mechanically mate with an exterior portion of the outer housing, thereby securably supporting the evacuated enclosure within the outer housing. The mounting assembly further includes structures for securing the x-ray tube within an x-ray generating device.

37 Claims, 11 Drawing Sheets

MOUNTING SYSTEM FOR AN X-RAY TUBE

BACKGROUND OF THE INVENTION

1. The Field of the Invention

The present invention generally relates to x-ray tubes. More particularly, the present invention relates to a mounting system for an x-ray tube that simplifies the loading and positioning of a tube insert within an outer housing of the tube.

2. The Related Technology

X-ray generating devices are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray devices operate in similar fashion. In general, x-rays are produced when electrons are emitted, accelerated, and then impinged upon a material of a particular composition. This process typically takes place within an evacuated enclosure of an x-ray tube. Disposed within the evacuated enclosure is a cathode and an anode oriented to receive electrons emitted by the cathode. The anode can be stationary within the tube, or can be in the form of a rotating annular disk that is mounted to a rotor shaft and bearing assembly. The evacuated enclosure is typically contained within an outer housing, which also serves as a coolant reservoir.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that at least some of the x-rays are emitted through x-ray transmissive windows defined in the evacuated enclosure and the outer housing. The emitted x-ray signal can then be used for a variety of purposes, including materials analysis and medical evaluation and treatment.

To assemble an x-ray tube as described above, the evacuated enclosure is typically secured within the outer housing using various internal mounting structures. While such structures adequately secure the evacuated enclosure, they nonetheless suffer from various setbacks. Among these is the fact that the use of such structures requires a relatively complex procedure and necessitates the expenditure of a significant amount of time and energy in properly mounting and aligning the evacuated enclosure within the outer housing. Because of the relatively complex procedure that must be followed, positioning of the evacuated enclosure within the outer housing to achieve optimum focal spot positioning of emitted x-rays can be difficult.

Further complicating the above situation is the fact that in many x-ray tubes the outer housing is filled with a dielectric oil that acts as both a conductive barrier and a cooling medium. Such oil-filled outer housings equate to even more time and expense when placing an evacuated enclosure within the housing during tube assembly because of the various fluid seals that must be included between the two components, especially in the x-ray passage region defined between the enclosure window and the window of the outer housing.

In addition, the aforementioned challenges consequently create further problems after initial tube assembly. An x-ray tube, once manufacture and assembly is complete, is typically disposed within an x-ray generating device, such as a CT scanner or mammography imaging apparatus, to produce x-rays needed for use by such devices. For instance, a mammography imaging apparatus produces images that are utilized to detect abnormal masses, such as tumors, in human breast material. An x-ray tube located within the mammography apparatus emits a beam of x-rays that enables such images to be produced. Such x-ray tubes can occasionally require replacement due to various conditions. When replacement is needed, it is frequently preferable to replace only the evacuated enclosure portion of the x-ray tube, as opposed to the entire x-ray tube, including the outer housing. Such on-site change-out of the evacuated enclosure portion of the x-ray tube, though desirable, is nonetheless often precluded because of the difficulties expressed above that are encountered when installing an evacuated enclosure within an outer housing.

In light of the above challenges, a need exists in the art for an improved x-ray tube mounting system. In particular, a mounting system is needed that enables tube components, such as the evacuated enclosure and outer housing, to be assembled and secured to one another in a simplified fashion, thereby saving time and resources otherwise spent during the assembly process. The mounting system should be capable of supporting the evacuated enclosure within the outer housing without the need for additional supporting structures. The mounting system should also readily provide for fixation of the x-ray tube to an x-ray generating device, such as a medical imaging apparatus. Finally, any mounting system should also enable mounting of the evacuated enclosure within the outer housing without regard to whether the outer housing is filled with dielectric oil.

BRIEF SUMMARY OF THE INVENTION

The present invention has been developed in response to the above and other needs in the art. Briefly summarized, embodiments of the present invention are directed to a system for mounting x-ray tube components within an x-ray generating device. Specifically, the present system includes means by which an evacuated enclosure of an x-ray tube is precisely fastened within an outer housing of the tube in a simple and straightforward manner to complete assembly of the tube. The system also provides for stable mounting of the assembled x-ray tube within an x-ray generating device, such as a medical imaging apparatus, for instance. As a result, the time and expense associated with x-ray tube assembly are reduced. Further, the mounting system facilitates the use of air-cooled x-ray tubes that do not utilize oil-filled outer housings for tube cooling purposes, thereby reducing the complexity of the tube and enhancing its overall safety.

Significantly, the present mounting system facilitates modular configurations for the x-ray tube, wherein the mounting system, evacuated enclosure, and/or outer housing can be readily replaced on-site wherever the x-ray tube is located, such as within an in-field x-ray imaging device. This ability to replace tube components on-site equates to a substantial time and cost savings when change-out of one or more of these components is necessary. Indeed, in one embodiment the modular character of the present invention enables the outer housing of the x-ray tube to be permanently mounted within an x-ray generating device while other tube components, such as the evacuated enclosure, can be readily installed or replaced within the outer housing as needed.

In one embodiment, the mounting assembly of the present invention generally comprises a clamp portion and a bracket portion. The clamp and bracket portions are configured to cooperate in securely and precisely positioning an evacuated enclosure within an outer housing of an x-ray tube. The evacuated enclosure includes a window assembly having a cylindrical extension circumscribed about a window, while the outer housing includes an aperture in the surface of the housing. These features cooperate with operation of the mounting assembly, as seen below.

The clamp portion is formed to comprise an annular ring of stainless steel. The annular ring has a slit defined radially through a portion thereof such that the ring has a "C"-shaped configuration. The slit in the clamp portion enables the size of a central aperture defined by the annular ring to expand or contract slightly in response to a tightening screw that passes through a portion of the ring and across the slit.

The bracket portion comprises a block of suitable material, such as aluminum, having a substantially planar first surface, a concave second surface, and an aperture extending between the two surfaces. The bracket portion receives a portion of the clamp portion in a circular recess and mechanically attaches to the clamp portion via a plurality of screws such that the aperture of the clamp is aligned with the bracket portion aperture.

The clamp portion is configured as described above to enable the aperture thereof to frictionally engage the cylindrical extension of the window assembly of the evacuated enclosure, thereby aligning the clamp and bracket portion apertures with the window. Correspondingly, the concave surface of the bracket portion above is configured to engage with and mechanically attach to a correspondingly shaped portion of the exterior of the outer housing. The bracket portion is attached to the outer housing such that the bracket portion aperture, clamp portion aperture and window, which are mutually aligned, are also aligned with the aperture defined in the housing, thereby creating an unobstructed path for x-rays produced in the evacuated enclosure to exit the x-ray tube. In this configuration, the evacuated enclosure is securely positioned within the outer housing by the mutually attached clamp and bracket portions of the mounting assembly. The bracket portion also provides a mounting surface with which the x-ray tube can be joined to a portion of an x-ray generating device, such as a mammography imaging apparatus, or other device.

By virtue of the connection scheme described above, the mounting assembly facilitates accurate and repeatable predetermined positioning of the evacuated enclosure within the x-ray tube outer housing. This, in turn, ensures that the window assembly of the evacuated enclosure is properly oriented with respect to the other portions of the x-ray tube. So oriented, accurate focal spot positioning for use by the x-ray generating device in which the x-ray tube is disposed is achieved, thereby leading to improved operation and enhanced results for the generating device.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale.

FIGS. 1-8B depict various features of embodiments of the present invention, which is generally directed to an x-ray tube having an improved mounting system. In particular, a mounting assembly is disclosed that simplifies the assembly process for an x-ray tube while, at the same time, improving the focal spot alignment thereof. Advantageously, the mounting assembly of the present invention is configured to not only mechanically attach an x-ray tube evacuated enclosure to an outer housing, but to also enable attachment of the x-ray tube to a portion of an x-ray generating device in which the x-ray tube is disposed. Use of the mounting assembly as disclosed herein is desirably employed in air-cooled x-ray tubes that avoid the use of oil-filled outer housings, thereby improving overall tube safety. Further details concerning these features and benefits will be examined in further detail in connection with the discussion found below.

Figure 1:
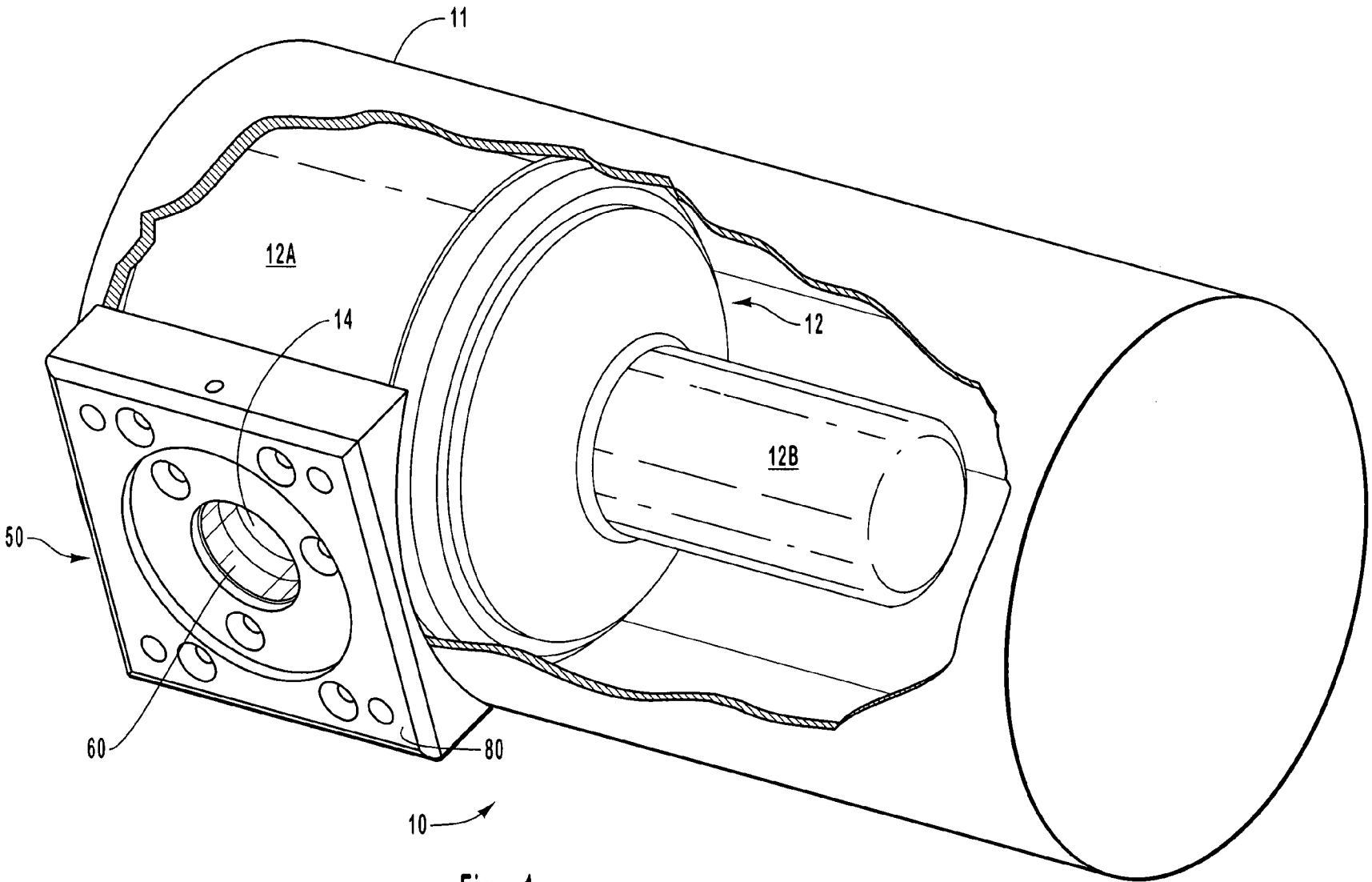
FIG. 1 is a simplified view of an x-ray tube, including a mounting assembly made in accordance with one embodiment of the present invention.

Reference is first made to FIG. 1, which illustrates a simplified structure of a cZ rotating anode-type x-ray tube, designated generally at 10. The x-ray tube 10 depicted here preferably comprises part of an x-ray generating device (not shown) for use in producing and emitting x-rays, as described above. Examples of x-ray generating devices include CT scanners and mammography imaging apparatus. The x-ray tube 10 includes an outer housing 11, shown here in phantom, within which is disposed an evacuated enclosure 12. The evacuated enclosure 12 is created by hermetically joining a first segment 12A with a second segment 12B. The first segment 12A generally contains a cathode, while the second segment 12B contains an anode (not shown). The anode is spaced apart from and oppositely disposed to the cathode, and is at least partially composed of a thermally conductive material such as tungsten or a molybdenum alloy. The anode is rotatably supported by a rotor shaft and a bearing assembly (not shown).

As is typical in the operation of x-ray tubes, a high voltage potential is provided between the anode and cathode. In the illustrated embodiment, the anode is biased by a power source (not shown) to have a large positive voltage, while the cathode is maintained at ground potential. While the x-ray tube 10 discussed here contains a rotating anode, it is appreciated that x-ray tubes having stationary anodes can also benefit from the high voltage connector to be described herein.

The cathode includes at least one filament that is connected to an appropriate power source (not shown). During operation, an electrical current is passed through the filament to cause electrons to be emitted from the cathode by thermionic emission. Application of the high voltage differential between the anode and the cathode then causes the electrons to accelerate from the cathode filament toward a target surface on the rotating anode. As the electrons accelerate, they gain a substantial amount of kinetic energy, and upon striking the anode, some of this kinetic energy is converted into electromagnetic waves of very high frequency, i.e., x-rays. A significant portion of the x-rays produced at the anode target surface possess trajectories that enable them to be transmitted through a window 14 that forms a portion of a window assembly 16 (FIGS. 5, 6) that is hermetically attached to the evacuated enclosure portion 12A and comprises a portion thereof. After passing through the window, the transmitted x-rays finally exit the x-ray tube through a passageway defined in the outer housing 11. They can then be used for a variety of purposes, according to the intended application. For instance, if the x-ray tube 10 is located within a medical x-ray imaging device, the x-rays emitted from the x-ray tube are directed for penetration into an object, such as a patient's body during a medical evaluation for purposes of producing a radiographic image of a portion of the body.

In accordance with one presently preferred embodiment of the invention, the x-ray tube 10 further includes a mounting assembly 50 that is configured for use in attaching the evacuated enclosure 12 of the tube to the outer housing 11 in a secure, positionally accurate orientation. The mounting assembly 50 is also configured to secure the x-ray tube 10 within an x-ray generating device, such as a medical x-ray imaging apparatus. As shown, the mounting assembly 50 is positioned to be aligned with the window 14 of the window assembly 16. So positioned, the mounting assembly 50 enables simplified and accurate attachment and positioning of the evacuated enclosure 12 with respect to the outer housing 11 while preventing obstruction of the x-rays that are emitted through the window 14 during tube operation. Further details relating to the positional relationship of the mounting assembly 50 and the x-ray tube 10 are given further below.

Figure 2B:
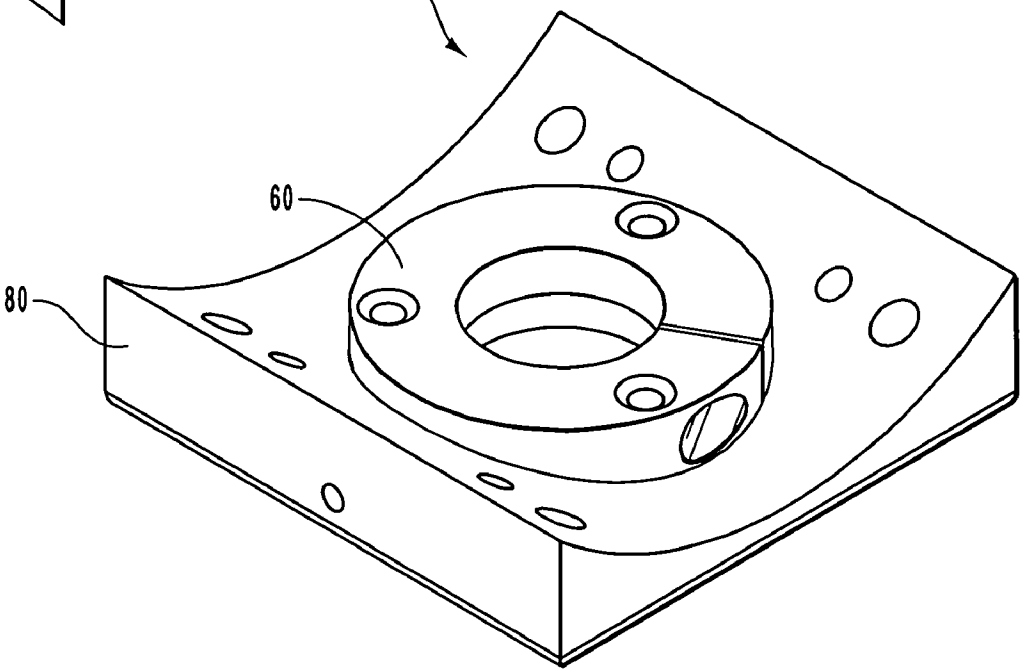
FIG. 2B is a perspective view of the mounting assembly of FIG. 2A.
Figure 2A:
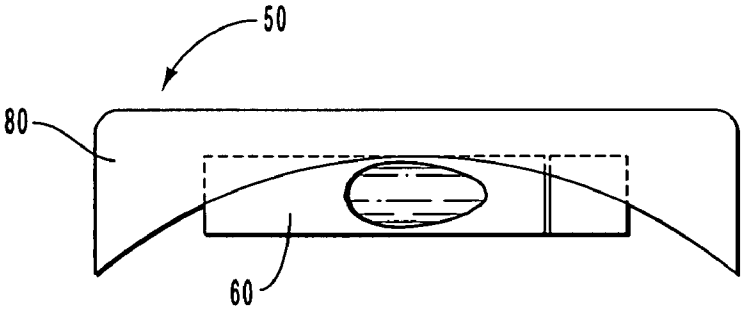
FIG. 2A is a side view of the mounting assembly included in FIG. 1 according to one embodiment thereof.

Reference is now made to FIGS. 2A and 2B, which show side and perspective views, respectively, of one embodiment of the mounting assembly 50. These figures depict the overall structure of the mounting assembly 50 which, in the present embodiment, generally comprises a clamp portion 60 and a bracket portion 80. The clamp portion 60 and the bracket portion 80 are mechanically attached together and serve as an interface for securing the evacuated enclosure 12 of the x-ray tube 10 in a specified position within the outer housing 11. Note that, though FIGS. 2A and 2B show the clamp portion 60 and the bracket portion 80 as discrete components that are mechanically attached to one another, it is possible to configure the present mounting assembly as a single, unitary component, if desired. Further, while the details to be shown and described in this application and the accompanying drawings are directed to selected embodiments, the mounting assembly of the present invention can vary from that shown and described in terms of structural design and functional details while still residing within the claims of the present invention.

Reference is now made together to FIGS. 3A, 3B, 3C, and 3D in describing various details regarding the clamp portion 60 of the mounting assembly 50 as shown in FIGS. 2A and 2B. These figures show the clamp portion 60 as comprising a clamp body 62 forming an annular ring, which in turn defines an aperture 64. In the present embodiment, the cross sectional shape of the annular ring forming the clamp body 62 is approximately square, though this shape can be modified in accordance with requirements of different applications. One portion of the clamp body 62 is radially cut to form a gap 66, which gives the clamp body a "C"-shaped configuration, best seen in FIG. 3B.

Figure 5:
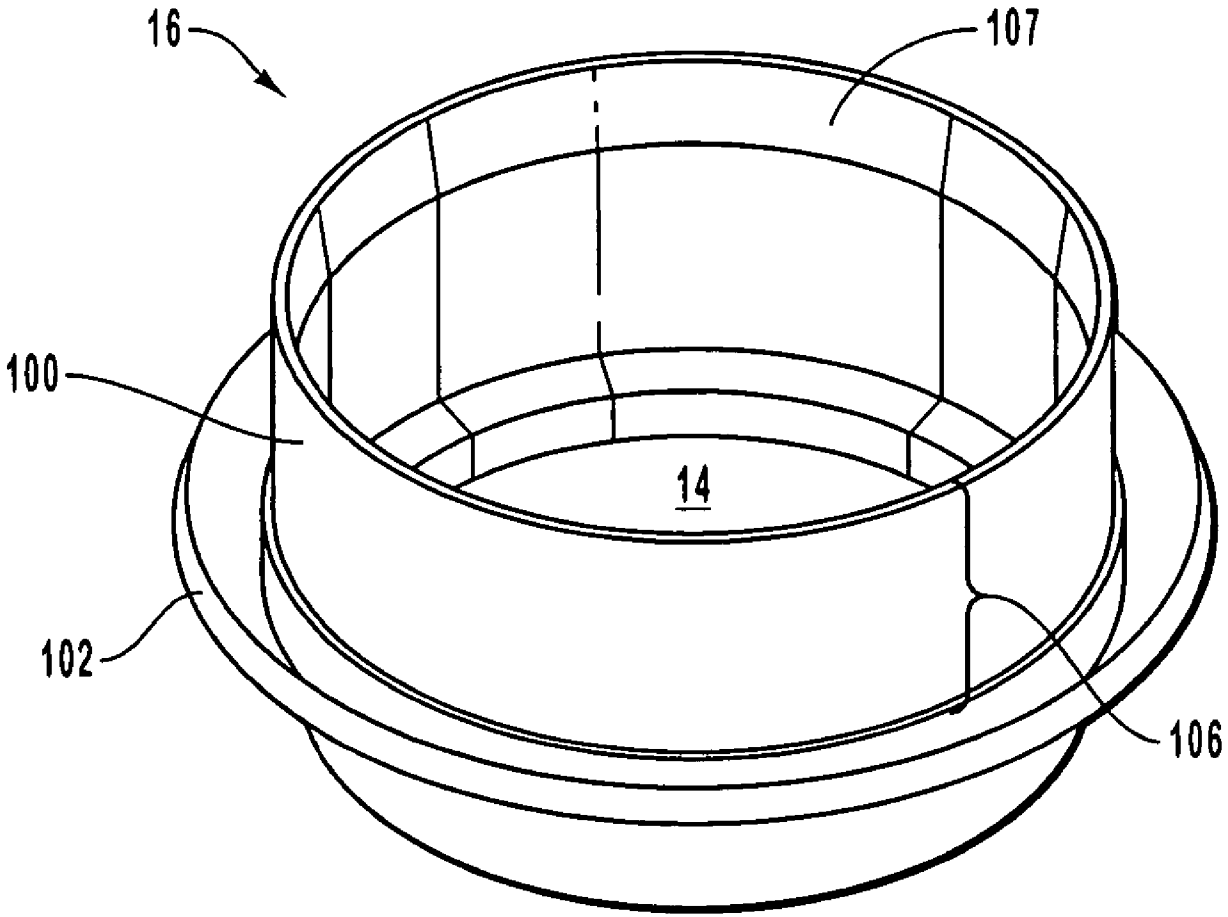
FIG. 5 is a perspective view of a window assembly comprising a portion of the x-ray tube shown in FIG. 1.
Figure 6:
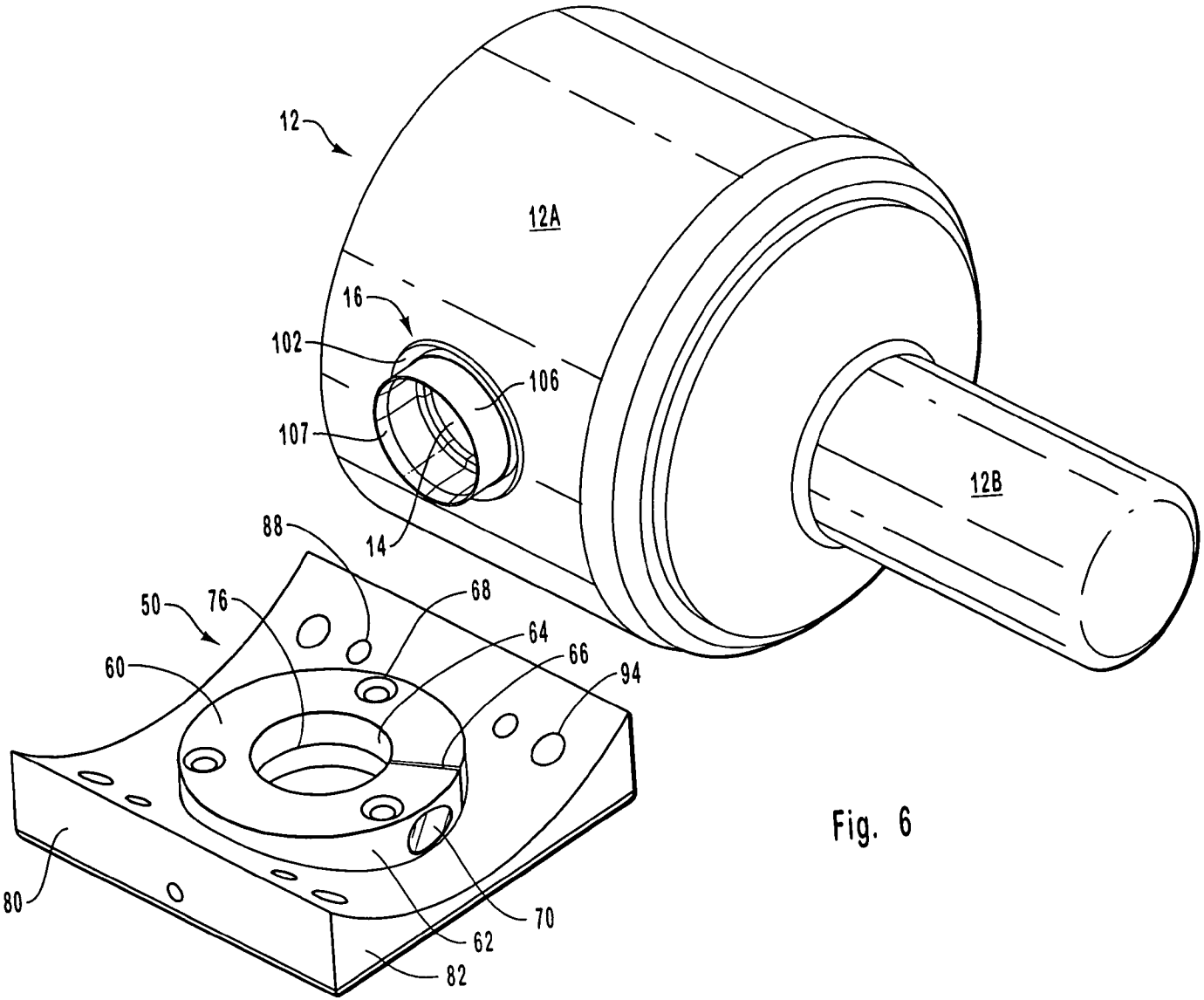
FIG. 6 is a perspective view of an evacuated enclosure of the x-ray tube and the mounting assembly of FIG. 1 in an initial, unattached configuration.

The clamp body 62 includes three attachment screw holes 68 defined through the body to facilitate attachment of the clamp 60 to the bracket portion 80. Though not explicitly shown, each of the attachment screw holes 68 (as well as each of the screw holes discussed herein) is preferably threaded to frictionally receive a correspondingly sized threaded screw therein. The clamp body 62 also includes a tightening screw hole 70 defined tangentially in the clamp body as to traverse the gap 66. The tightening screw hole 70 is formed across the gap 66 to enable closing of the gap 66 by threaded engagement of an appropriately configured tightening screw (not shown) with threads (not shown) defined in the tightening screw hole on either side of the gap. Closing of the gap 66 in turn results in a reduction in the diameter of the aperture 64. As will be seen, reduction in the size of the aperture 64 enables the clamp portion to frictionally attach to a portion of the evacuated enclosure 12, namely, the window assembly 16 (FIGS. 5 and 6).

Figure 3B:
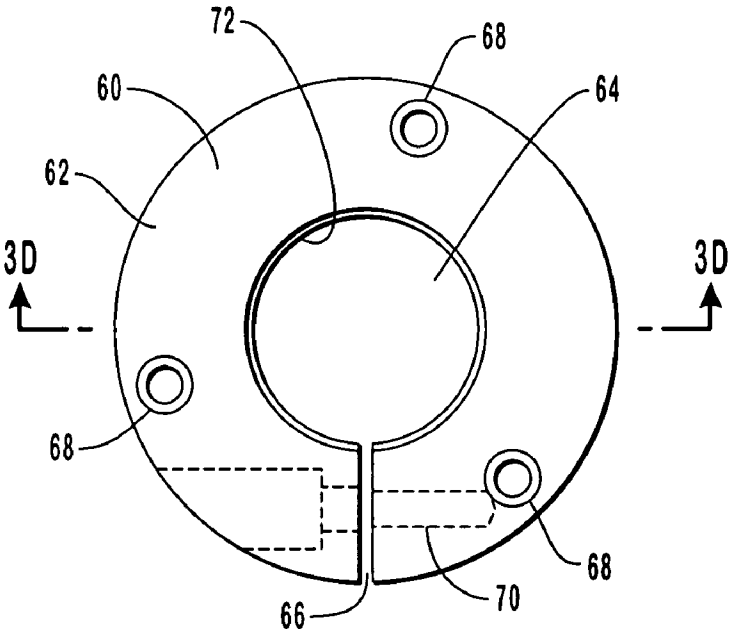
FIG. 3B is a top view of the clamp portion of FIG. 3A.
Figure 3D:
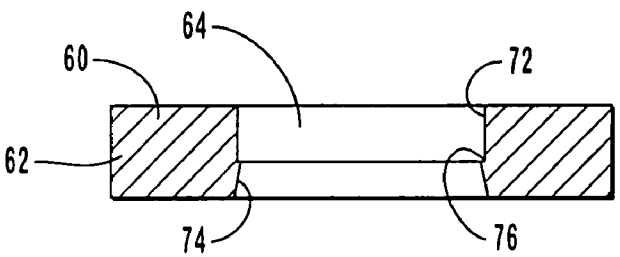
FIG. 3D is a cross sectional side view of the clamp portion of FIG. 3B, taken along the lines 3D-3D.
Figure 3A:
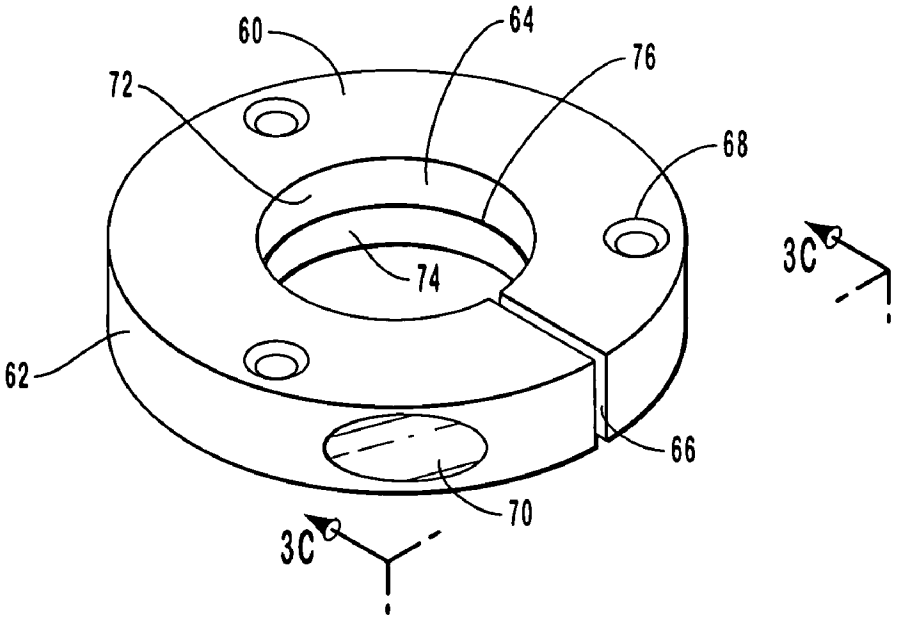
FIG. 3A is a perspective view of a clamp portion of the mounting assembly of the present invention.
Figure 3C:
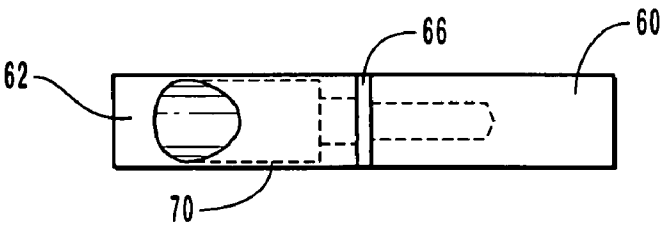
FIG. 3C is a side view of the clamp portion of FIG. 3A, taken along the lines 3C-3C.

As best seen in FIG. 3D, a circumferential surface 72 of the clamp body 62 defines the aperture 64 and includes various features. Among these is an annularly defined chamfer portion 74 that extends from an annular ridge 76 on the circumferential surface. The ridge 76 can be used when mating the mounting assembly 50 to the window assembly 16 (FIGS. 5, 6) to ensure that a proper alignment and orientation is achieved between the two components, as will be explained. The chamfer portion 74 of the aperture 64 is shaped as seen in FIG. 3D to prevent obstruction by the clamp portion 60 of the conically diverging x-ray beam that is emitted through the window assembly 16 during tube operation.

The clamp body 62 is preferably formed from a material having acceptable x-ray properties, i.e., a material that will not structurally deteriorate to a significant degree when impinged with x-rays over time. In one embodiment, the clamp body 62 is formed from stainless steel, though other suitable materials such as aluminum, brass, steel, and copper can alternatively be used. Stainless steel also exhibits other desirable properties as the clamp body material: stainless steel retains a structural "memory" when deformed slightly from its original shape. Thus the clamp body 62, when slightly deformed to form a smaller aperture 64 by action of the tightening screw (not shown) in reducing the size of the gap 66, will typically restore itself to its original undeformed shape when the tightening screw is or Z loosened within the tightening screw hole 70.

Figure 4C:
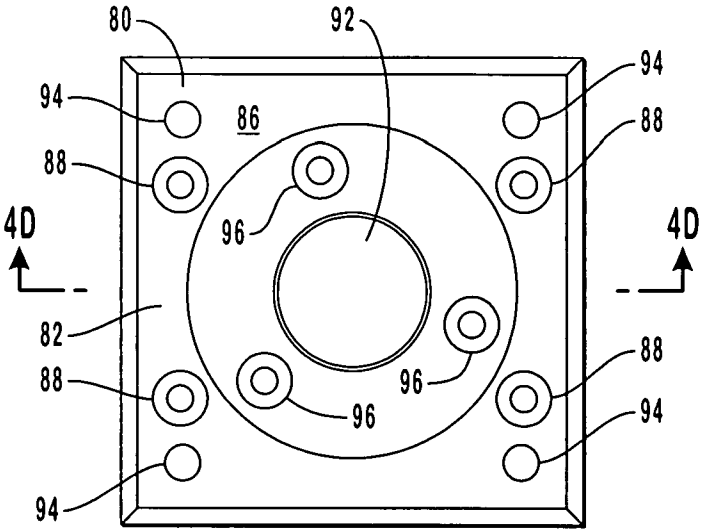
FIG. 4C is a top view of the bracket portion of FIG. 4A.
Figure 4D:
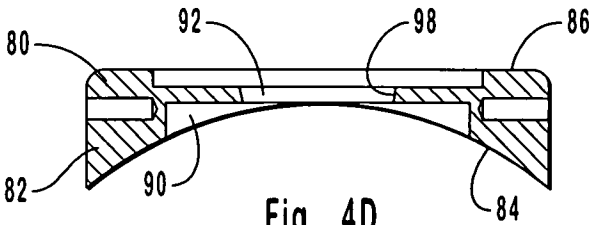
FIG. 4D is a cross sectional side view of the bracket portion of FIG. 4C, taken along the lines 4D-4D.
Figure 4E:
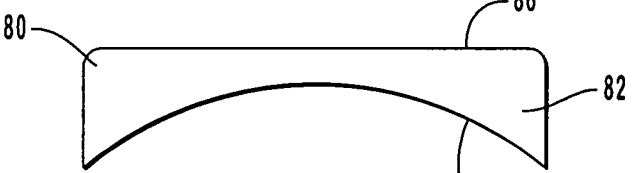
FIG. 4E is a side view of the bracket portion of FIG. 4B, taken along the lines 4E-4E.
Figure 4A:
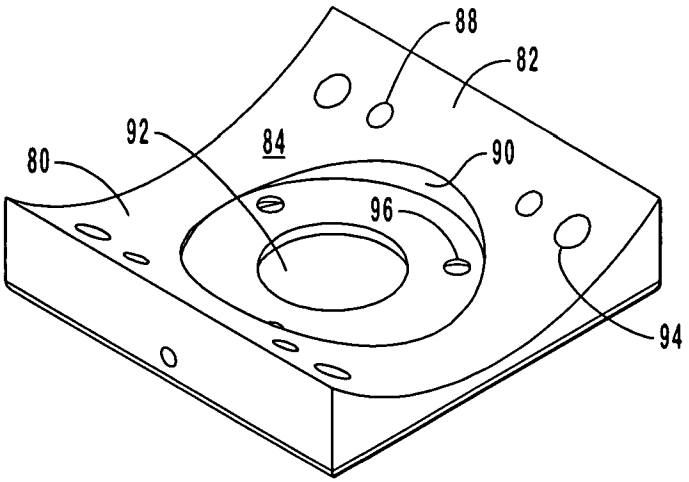
FIG. 4A is one perspective view of a bracket portion of the mounting assembly of the present invention.
Figure 4B:
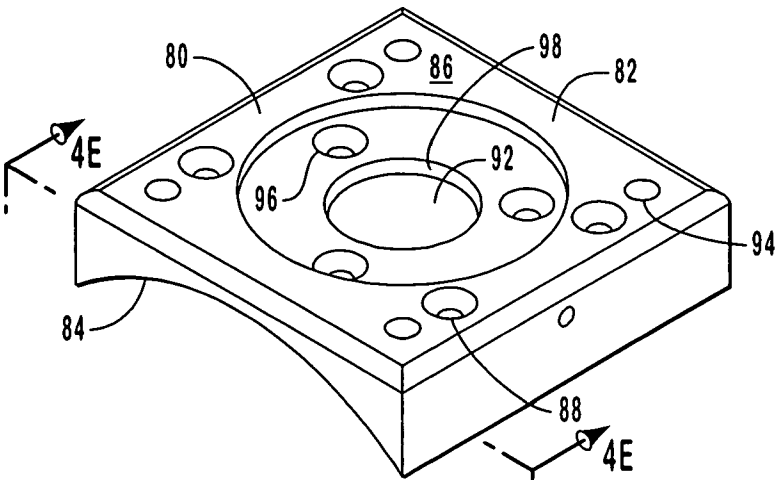
FIG. 4B is another perspective view of the bracket portion of FIG. 4A.

Reference is now made to FIGS. 4A, 4B, 4C, 4D, and 4E in describing various details concerning the bracket portion 80 of the mounting assembly 50. FIGS. 4A and 4B illustrate the general configuration of the bracket portion 80, which includes a block-like bracket body 82 having a concavely shaped first surface 84 and a generally planar second surface 86. The concave bracket body first surface 84 is so shaped as to enable it to cooperatively fit with a corresponding exterior portion of the generally cylindrical outer housing 11 (FIGS. 8A, 8B), as described further below. As such, it is conceivable that the first surface 84 could alternatively comprise other shapes to fit with x-ray tube outer housings having exterior shapes differing from that shown in the accompanying drawings. Four attachment screw holes 88 are defined in the bracket body 82 to enable attachment between the mounting assembly 50 and the outer housing 11.

Also defined on the bracket body first surface 84 are a circular recess 90 and a bracket body aperture 92. The bracket body aperture 92 extends between the bracket body first surface 84 and second surface 86, and is defined concentrically with respect to the recess 90. When the bracket portion 80 is joined with the clamp portion 60 (as described further below), a portion of it is received in the circular recess 90 such that the bracket body aperture 92 is aligned with the clamp body aperture 64. This in turn enables the x-ray beam produced by the x-ray tube 10 and emitted via the window 14 (FIG. 1) to pass unobstructed through the mounting assembly 50 when the mounting assembly is attached to the evacuated enclosure 12.

As best seen in FIGS. 4B and 4C, the second surface 86 of the bracket portion 80 is configured to enable the bracket portion to attach to a corresponding support surface such as, for instance, a mounting area within an x-ray generating device (e.g., a CT scanner, mammography imaging apparatus, etc.). To that end, the first surface 84 includes a plurality of screw holes 94 that are configured to receive correspondingly sized screws for attaching the mounting assembly 50 (and by extension, the x-ray tube 10) to the x-ray generating device (not shown) in either a direct or indirect configuration. The particular surface shape of the second surface 86 can also be altered from what is illustrated here to conform it to a particular mounting surface in the x-ray generating device.

The bracket body 82 further includes three attachment screw holes 96 extending between the first and second surfaces 84 and 86 thereof. The screw holes 96 cooperate with the attachment screw holes 68 defined in the clamp portion 60 when the clamp portion and the bracket portion 80 are properly aligned to facilitate their attachment to one another. Correspondingly sized screws (not shown) pass from the bracket portion 80 to the clamp portion 60 via the attachment screw holes 96 and 68, respectively, to affix the clamp portion to the bracket portion in an arrangement as shown in FIGS. 2A and 2B, thereby forming the mounting assembly 50. In this configuration, the mounting assembly 50 can be attached to both the evacuated enclosure 12 and the outer housing 11 of the x-ray tube 10 to secure these components together. Also, and as mentioned, the mounting assembly 50 can then be utilized in securing the x-ray tube 10 to an x-ray generating device (not shown).

Inspection of FIG. 4C will reveal, then, that three sets of screw holes exist on the bracket portion 80: the attachment screw holes 88 for securing the bracket portion to the outer housing 11, screw holes 94 for securing the bracket portion to an x-ray generating device (not shown), and attachment screw holes 96 for securing the bracket portion to the clamp portion 60. Though FIGS. 4A-4E show one embodiment for arranging the various screw holes described above, it is appreciated that not only the number and position of these screw holes can be altered to suit a particular configuration, but the presence or absence of these screw holes, according to need, can also be modified. For instance, straps or other attachment means could be employed to secure the clamp portion 60 to the bracket portion 80, and/or to secure attachment between the mounting assembly 50 and the evacuated enclosure 12 or other tube components.

FIGS. 4D and 4E depict the specified shape of the bracket portion 80 as particularly defined by the first and second surfaces 84 and 86 thereof, as already discussed above. In particular, FIG. 4D shows the extension of the bracket body aperture 92 between the substantially concave first surface 84 and the substantially flat second surface 86 of the bracket portion 80. As already mentioned, the bracket body aperture 92 aligns with the clamp body aperture 64 (FIG. 3D) to define an x-ray beam path through the mounting assembly 50 when the assembly is mounted about the window assembly 16 in a manner to be described below. To that end, a chamfer portion 98 is defined on the bracket body aperture 92 adjacent the recess 90. The chamfer portion 98, like the chamfer portion 74 of the clamp body aperture 64, is configured to prevent the aperture from obstructing the conically diverging flow of x-rays through the mounting assembly 50 during tube operation. The details as to the particular size and shape of both apertures described above can be modified according to the specific characteristics of both the x-ray tube and the mounting assembly.

Like the clamp portion 60, the bracket portion 80 can be formed from one of a variety of materials having suitable x-ray properties (i.e., resistance to structural deterioration in the presence of x-rays). Aluminum is one preferred material from which the bracket portion 80 can be formed, though brass, steel, copper, and other materials can alternatively be used.

Reference is now made to FIG. 5, which depicts various features of the window assembly 16. As discussed above, the window assembly 16 is hermetically joined to the evacuated enclosure portion 12A of the x-ray tube 10 and is considered a part of the evacuated enclosure. The window assembly 16 provides an x-ray transmissive region through which x-rays that are produced within the evacuated enclosure 12 can escape the enclosure and be directed as desired for use by the x-ray generating device. As such, the window assembly 16 generally includes a hollow, cylindrical body 100, a weld flange 102, and the x-ray transmissive window 14. The window 14 is placed within the cylindrical volume defined by the body 100 and hermetically attached thereto, as seen in FIG. 5.

In the illustrated embodiment, the weld flange 102 is located approximately adjacent the level at which the window 14 is located within the cylindrical body 100. The weld flange 102 is annularly defined about an exterior portion of the body 100 and serves as a joining surface between the window assembly 16 and the evacuated enclosure 12. Specifically, the weld flange 102 of the window assembly 16 can be brazed or welded to the perimeter of an aperture defined in the evacuated enclosure 12, thereby forming a hermetic seal therebetween. So joined, the window 14 is positioned to enable the passage therethrough of x-rays produced within the evacuated enclosure 12.

FIG. 5 also shows a hollow cylindrical portion of the cylindrical window assembly body 100 that extends beyond the point of attachment of the weld flange 102 with the evacuated enclosure 12. This extended portion 106 of the window assembly body 100 extends beyond the outer surface of the evacuated enclosure 12 when the window assembly 16 is attached thereto (see FIG. 7B). As such, the extended portion 106 is used as an attachment surface for attaching the clamp portion 60 of the mounting assembly 50 to the evacuated enclosure 12, as will be explained. As such, the window assembly body 100 is preferably formed of a structurally strong material, including certain metals and metal alloys. The inner surface of the extended portion 106 includes an annular chamfer portion 107. The chamfer portion 107 cooperates with the chamfer portion 74 of the clamp body aperture 64 and the chamfer portion 98 of the bracket body aperture 92 when the mounting assembly 50 is attached to the window assembly 16 to prevent obstruction of x-rays emitted through the window 14 during x-ray production.

The discussion to follow in connection with FIGS. 6-8B deals with various details regarding the simplified inter-attachment between the evacuated enclosure 12 and outer housing 11 of the x-ray tube 10 made possible by the mounting assembly 50, according to one presently preferred embodiment. It is to be remembered, however, that various aspects of the present mounting assembly as will be described can be modified according to need, as appreciated by one who is skilled in the art.

Reference is now made to FIG. 6. As depicted, FIG. 6 shows both the evacuated enclosure 12 and the mounting assembly 50 in a separated state before mutual attachment. This figure shows the general positional relationship that exists between the evacuated enclosure 12 and the mounting assembly 50 when mating thereof is later performed. As is seen, the mounting assembly 50 is disposed in its fully assembled state, wherein the clamp portion 60 is received into the recess 90 of the bracket portion 80 and attached to the bracket portion via screws located in the attachment screw holes 68. In the attached state, the aperture 64 of the clamp body 62 and the aperture 92 of the bracket body 82 are aligned with one another. The concave first surface 84 of the mounting assembly 50 generally faces toward the outer surface of the evacuated enclosure, while the extended portion 106 of the window assembly body 100 is generally aligned for engagement with the clamp body aperture 64.

Figure 7A:
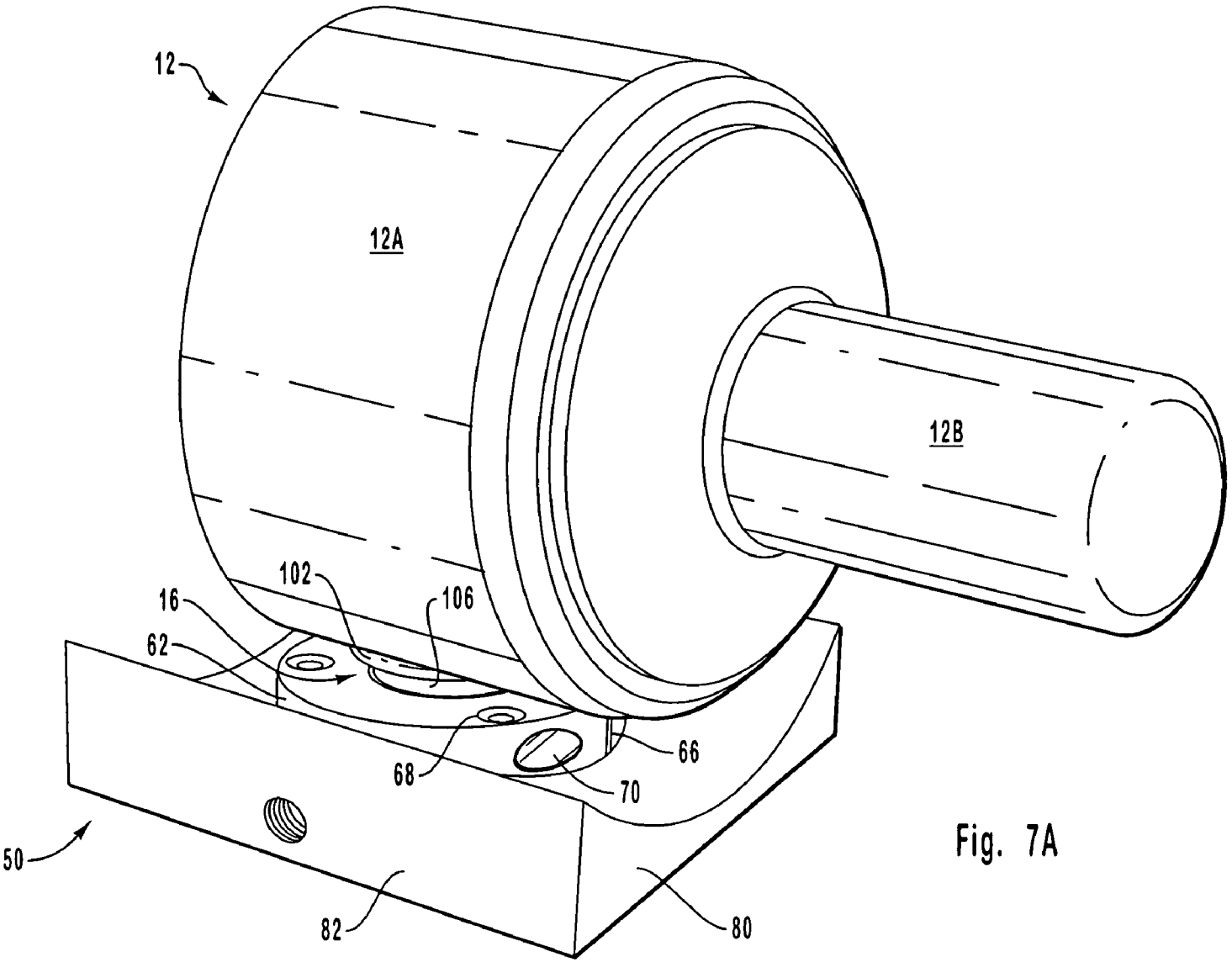
FIG. 7A is a perspective view of the evacuated enclosure and mounting assembly of FIG. 6 in an attached configuration.
Figure 7B:
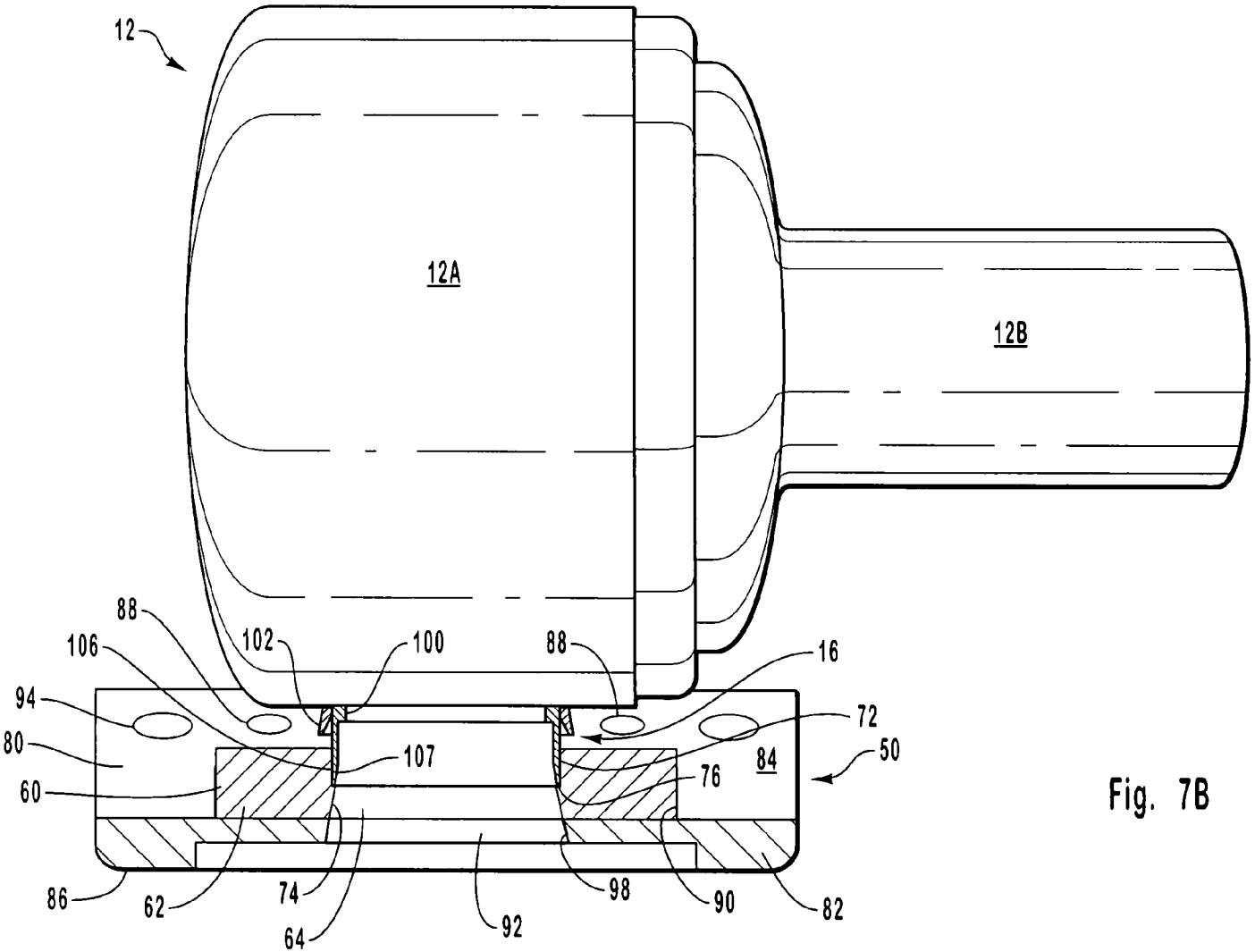
FIG. 7B is a partial cross sectional/side view of the evacuated enclosure and attached mounting assembly of FIG. 7A.

FIGS. 7A and 7B depict the evacuated enclosure 12 and the mounting assembly in a second, attached state, in contrast to FIG. 6. Inspection of these figures will reveal that the mounting assembly 50 is securely attached to the window assembly 16 of the evacuated enclosure 12. Specifically, the clamp portion 60 frictionally engages the extended portion 106 of the window assembly body 100. This is accomplished by receiving the extended portion 106 into the clamp body aperture 64 until the end of the extended portion seats against the annular ridge 76 defined in the clamp body aperture. Once the extended portion 106 is properly seated, the screw located in the tightening screw hole 70 is tightened to close the gap 66, which reduces the diameter of the clamp body aperture 64, and causes the clamp body 62 to frictionally engage the extended portion 106 of the window assembly 16. In this way, a secure attachment is achieved between the window assembly 16 and the mounting assembly 50 such that the evacuated enclosure 12 can be structurally supported by the mounting assembly alone without supplemental support from other sources within the x-ray tube 10. As will be seen, the mounting assembly 50 also attaches the evacuated enclosure 12 to the x-ray tube outer housing 11.

As best seen in FIG. 7B, the apertures 64 and 92 of the clamp portion body 62 and bracket portion body 82, respectively, are both aligned with the extended portion 106 of the window assembly body 100 when the mounting assembly is attached to the evacuated enclosure. This enables x-rays emitted from the window 14 (FIG. 6) to pass through the mounting assembly 50 without obstruction. Ultimately, the precise alignment achieved between the mounting assembly 50 and the window assembly 16 enables the evacuated enclosure 12 to be precisely and repetitively positioned with respect to other tube components. As a result, improved focal spot alignment of the x-ray beam is achieved, thereby leading to improved tube operation and performance.

It should be noted that FIGS. 7A and 7B depict only the positional relationship between the mounting assembly 50 and the evacuated enclosure 12 in their attached configuration and do not necessarily depict a chronological order in which the various components of the x-ray tube 10 are assembled. The order in which the various components described herein are attached and assembled will be given below. Of course, attachment orders that differ from that to be described herein are also contemplated.

Figure 8A:
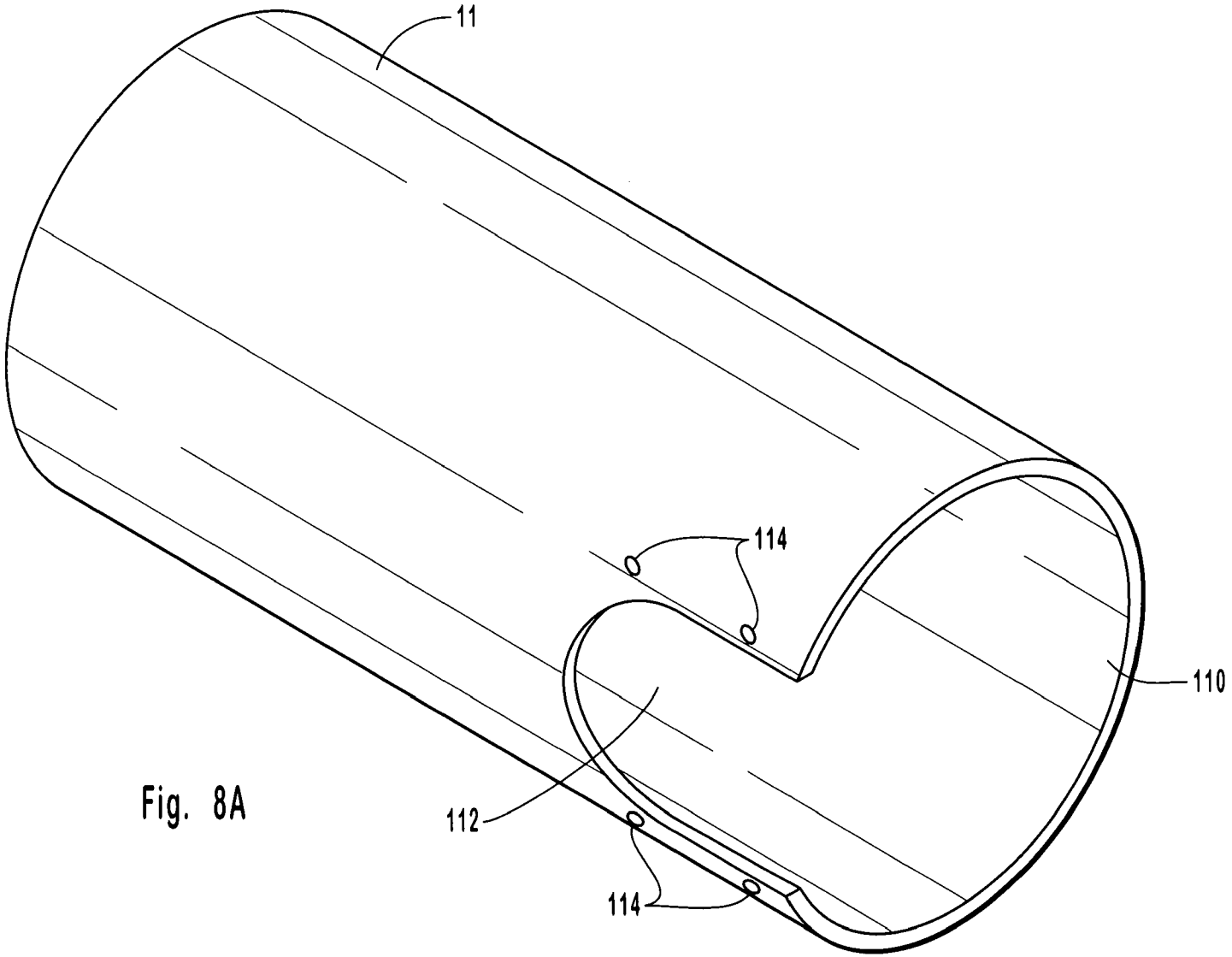
FIG. 8A is a perspective view of an outer housing of an x-ray tube configured for use in accordance with embodiments of the present invention.

Reference is now made to FIG. 8A, which depicts a perspective view of the outer housing 11, comprising part of the x-ray tube 10. The outer housing 11 generally comprises a hollow cylindrical shape and serves to house the evacuated enclosure 12 and related tube components within an inner volume 110 that is defined by the housing. FIG. 8A further depicts an aperture 112 that is cut into the outer housing 11. The aperture 112 generally corresponds in size to the mounting assembly 50, thereby providing a location on the surface of the outer housing 11 whereon the mounting assembly 50 can be attached. Four holes 114 are defined adjacent the aperture 112 and are positioned to receive screws in order to secure the mounting assembly 50 to the outer housing 11, as will be seen below.

Figure 8B:
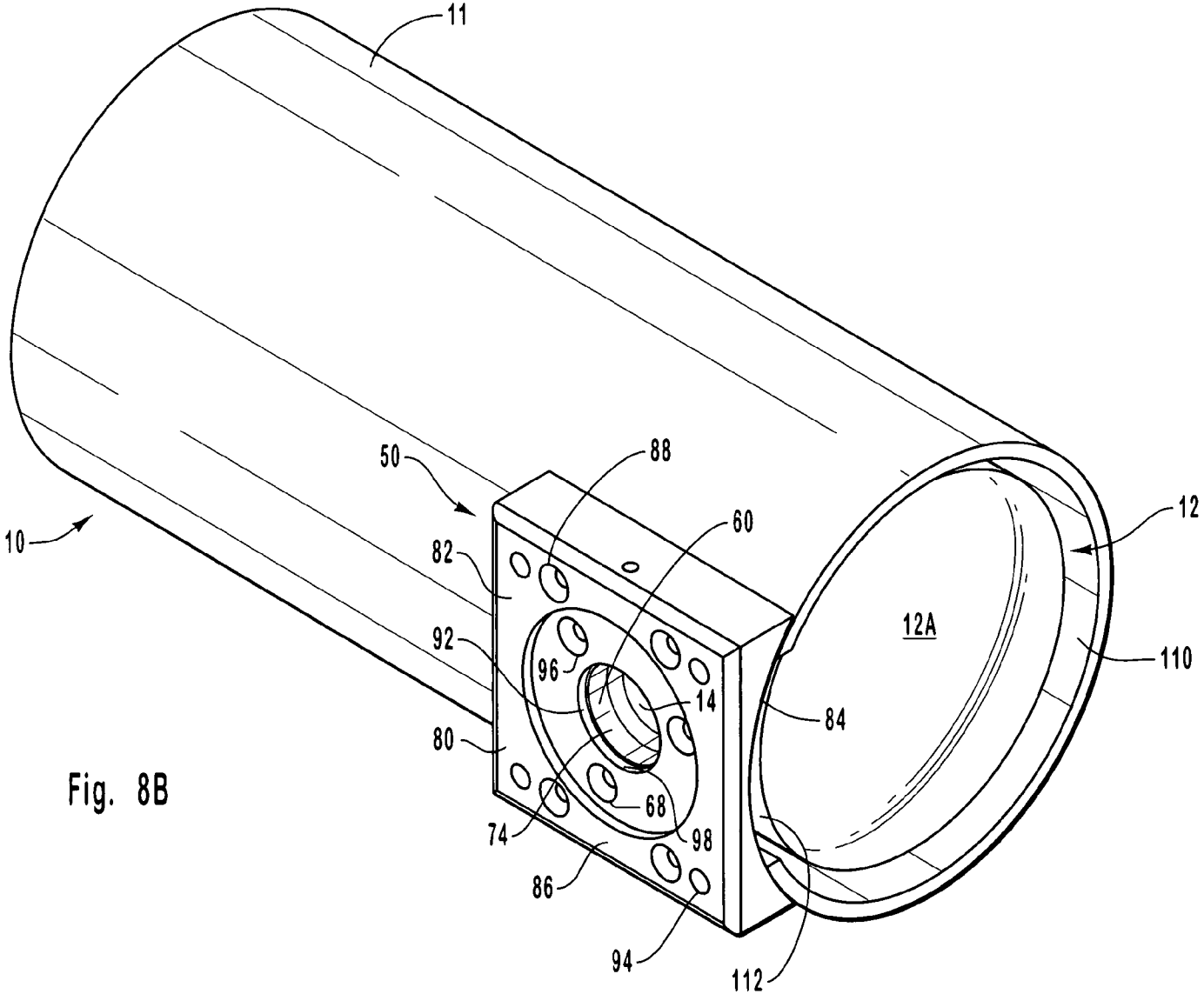
FIG. 8B is a perspective view of the outer housing of FIG. 8A having an evacuated enclosure and mounting assembly of an x-ray tube configured in accordance with one embodiment of the present invention attached therewith.

FIG. 8B depicts various components of the x-ray tube 10 as assembled. In particular, FIG. 8B shows the outer housing 11 having the evacuated enclosure 12 received into the inner volume 110 thereof. The mounting assembly 50 is also shown, seated in its proper position over the aperture 112 of the outer housing 12. The clamp portion 60 of the mounting assembly 50 in this configuration is attached to the window assembly 16 of the evacuated enclosure 12 in the manner already described above. This connection between the clamp portion 60 and the window assembly 16 extends through the aperture 112 of the outer housing 11.

In presently preferred embodiments, the assembled configuration of the x-ray tube 10 as shown in FIG. 8B proceeds as explained here. First, the clamp portion 60 is attached to the bracket portion as explained above to form the mounting assembly 50. The screws that pass through the attachment screw holes 96 of the bracket portion body 82 FIG. 4A-4C) and through the attachment screw holes 68 of the clamp body 62 (FIGS. 3A, 3B) to secure the clamp portion 60 to the bracket portion 80 are left slightly loose at this point to enable component adjustment during the assembly process as needed. The evacuated enclosure 12 is then received into the inner volume 110 of the outer housing 11. The clamp portion 60 is then attached to the window assembly 16 as explained above, which correspondingly attaches the mounting assembly 50 to the evacuated enclosure 12 via the aperture 112 defined in the outer housing 11.

Once the mounting assembly 50 is attached to the evacuated enclosure 12 disposed in the inner volume 110 of the outer housing 11, the mounting assembly is securely fastened to the exterior of the outer housing using screws that pass through the attachment screw holes 88 of the mounting assembly and into the holes 114 defined in the outer housing. Any screws not already securely tightened (such as the screws for attaching the clamp portion 60 and the bracket portion 80 together) can be tightened at this point. A top cover (not shown) can then be placed to cover the open end of the outer housing 11. In this way, the evacuated enclosure 12 is simply, accurately, and securely positioned within the outer housing 12, via the mounting assembly 50 as disclosed herein. In this configuration, the evacuated enclosure 12 is fully supported within the outer housing such that a gap exists between the outer surface of the evacuated enclosure portion 12A and the inner surface of the outer housing 11. Final assembly steps can then be taken to complete the x-ray tube 10 assembly and prepare it for operation.

At this point, the x-ray tube 10 can be secured within an appropriate x-ray system, such as a CT scanner or a mammography imaging device. This attachment can be made using the screw holes 94 that are defined in the bracket portion 80 of the mounting assembly 50. In lieu of screw fastening as described herein, other means for securing the various components of the present x-ray tube can also be employed.

Figure 9:
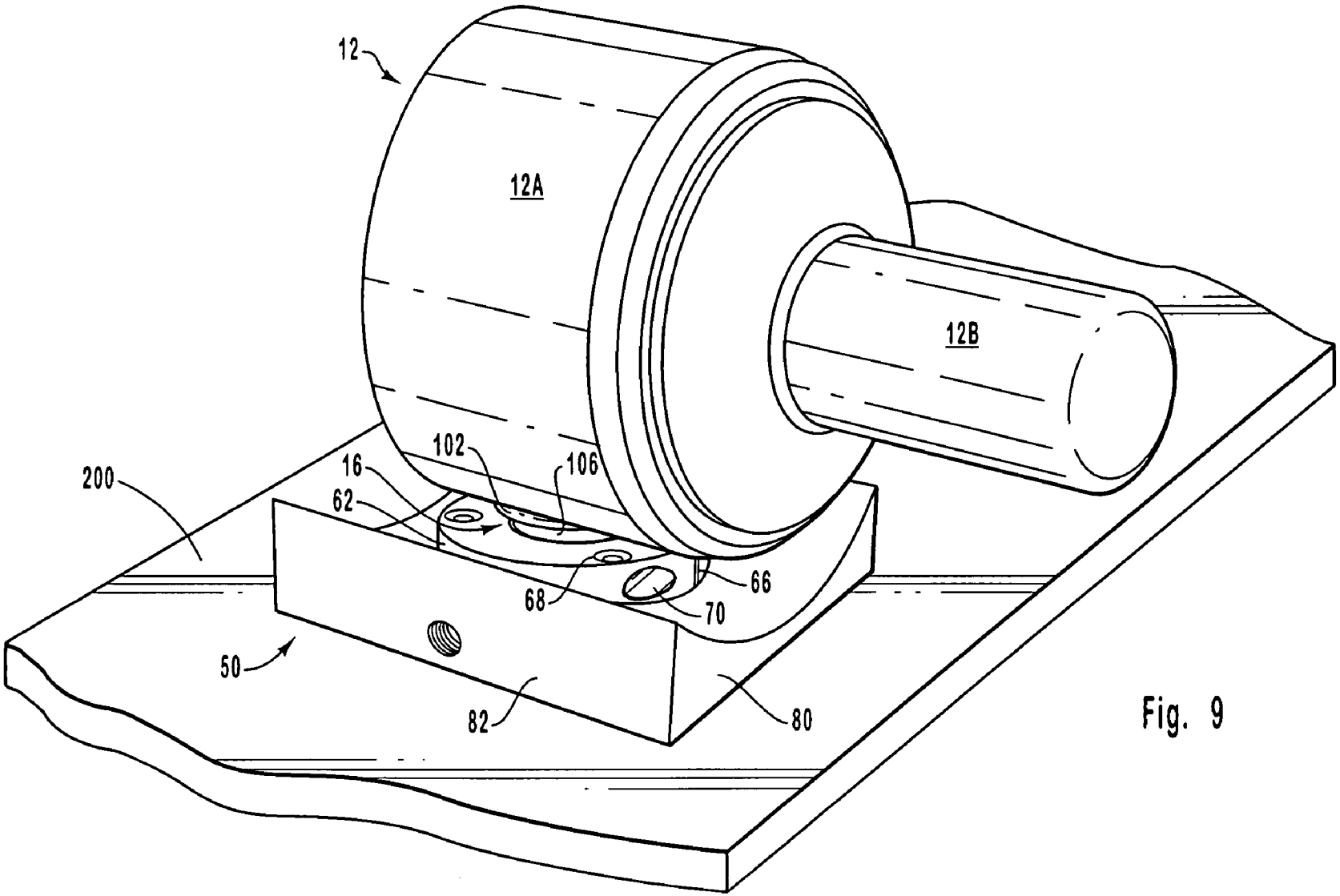
FIG. 9 is a perspective view of an x-ray tube attached to an x-ray device via a mounting assembly, in accordance with another embodiment of the present invention.

Reference is now made to FIG. 9, which shows an alternative mounting configuration for an x-ray tube utilizing the mounting assembly of the present invention. It is appreciated that, in one embodiment, the present mounting assembly can be used in securing an x-ray tube to a device without an intervening outer housing, as in the previous embodiment. One such embodiment is shown in FIG. 9, wherein the vacuum enclosure 12 of an x-ray tube is shown mechanically attached to the mounting assembly 50 in the same manner as described above. The mounting assembly 50 is in turn mounted to a surface of a device 200. Mechanical fasteners, such as screws that each threadably engage the screw holes 94 (FIG. 8B), or other suitable means can be used to secure the mounting assembly 50 to the device 200. So secured, the mounting assembly 50 provides a stable mount for the evacuated enclosure 12, thereby securing it in a specified orientation with respect to the device 200. An aperture (not shown) can be defined as needed in the device 200 to enable the passage of x-rays from the window 14 (FIG. 8B) of the evacuated enclosure 12. Note again that no outer housing is employed in the embodiment depicted in FIG. 9.

The device 200 can include one of a variety of devices in connection with which an x-ray tube can be employed. For example, in one implementation the device 200 is a gantry used in a medical imaging apparatus. In another implementation, the device 200 can be a diagnostic testing apparatus that can be used to test the x-ray tube during the tube manufacturing process. In this implementation, use of the mounting assembly as described herein allows for quick mounting and de-mounting of the x-ray tube, thereby streamlining the testing and evaluation process.

The particular shape of the mounting assembly 50 shown in FIG. 9 is merely exemplary. Indeed, the various surfaces of the mounting assembly 50, such as the second surface 86 of the bracket portion 80 (FIG. 8B), can be shaped to correspond with a particular mounting surface of either the device 200 or the x-ray tube. For instance, the second bracket surface 86 is flat in FIG. 9 to cooperatively mount to a similarly flat surface of the device 200.

Though it has been presented herein in connection with a cathode grounded mammography x-ray tube, the mounting assembly of the present invention can be acceptably employed with x-ray tubes of various types and configurations, including single and double ended tubes, low and high voltage tubes, stationary and rotary anode tubes, and tubes designed for different applications, including industrial, CT, etc.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube, comprising:

an evacuated enclosure containing an electron source and an anode positioned to receive electrons produced by the electron source;

an outer housing containing the evacuated enclosure; and a mounting assembly configured to mechanically support the evacuated enclosure within the outer housing, comprising:

a first mounting portion that mechanically attaches to an outer surface of the outer housing; and a second mounting portion that mechanically attaches to a portion of the evacuated enclosure, the second mounting portion comprising a clamp that is at least partially received within the first mounting portion.

2. An x-ray tube as defined in claim 1, wherein the first mounting portion comprises a bracket that attaches to the second mounting portion using a plurality of screws.

3. An x-ray tube as defined in claim 2, wherein the bracket is substantially composed of aluminum.

4. An x-ray tube as defined in claim 1, wherein the clamp frictionally engages a portion of a window assembly, the window assembly comprising a portion of the evacuated enclosure.

5. An x-ray tube as defined in claim 4, wherein screws are used to mechanically attach a bracket to the outer housing and to attach the clamp to the bracket.

6. An x-ray tube as defined in claim 1, wherein the mounting assembly is further configured to mechanically attach the x-ray tube to a portion of an x-ray generating device.

7. The x-ray tube as recited in claim 1, wherein the first and second mounting portions removably attach to each other.

8. The x-ray tube as recited in claim 1, wherein the first mounting portion comprises a pair of opposing surfaces, one of which is substantially planar, and the other of which has a shape that substantially conforms with the outer surface of the outer housing.

9. The x-ray tube as recited in claim 1, wherein the first and second mounting portions each define a corresponding aperture, the apertures being substantially aligned with each other and with a window of the x-ray tube.

10. An x-ray tube comprising:

an evacuated enclosure containing an electron source and an anode positioned to receive electrons produced by the electron source;

an outer housing containing the evacuated enclosure; and a mounting assembly, a substantial portion of the mounting assembly being positioned outside the outer housing, and the mounting assembly comprising:

a bracket portion mechanically attached to a portion of the outer housing of the x-ray tube; and a clamp portion frictionally engaged to a portion of the evacuated enclosure of the x-ray tube proximate an x-ray transmissive window located on a surface of the evacuated enclosure, the clamp portion being mechanically attached to the bracket portion through an aperture defined in a surface of the outer housing such that the mounting assembly supports the evacuated enclosure in a specified position within the outer housing.

11. An x-ray tube as defined in claim 10, wherein the window comprises part of a window assembly that is attached to a surface of the evacuated enclosure, and wherein the clamp portion frictionally engages a cylindrical portion of the window assembly that extends about the periphery of the window.

12. An x-ray tube as defined in claim 11, wherein the clamp portion comprises an annular ring having a radial cut defined therethrough, the cut enabling an aperture defined by the annular ring to frictionally engage with the cylindrical portion of the window assembly such that the aperture is aligned with the window thereof.

13. An x-ray tube as defined in claim 12, wherein the bracket portion further comprises an aperture that aligns with the window and with the aperture of the clamp portion when the bracket portion and clamp portion are mechanically attached.

14. An x-ray tube as defined in claim 10, wherein the bracket portion has at least one surface that is shaped to physically engage a corresponding portion of the outer housing.

15. An x-ray tube as defined in claim 14, wherein the at least one surface of the bracket portion is a concave surface.

16. An x-ray tube as defined in claim 10, wherein the anode of the x-ray tube is a rotary anode.

17. An x-ray tube as defined in claim 10, wherein the bracket portion further comprises a circular recess in which the clamp portion is at least partially received when the clamp portion is mechanically attached to the bracket portion, the circular recess being concentric with the aperture defined in the surface of the outer housing.

18. In an x-ray tube, a method of joining an evacuated enclosure to a structure, the evacuated enclosure including a window assembly attached to an aperture defined in the evacuated enclosure, the method comprising:

attaching a clamp portion of a mounting assembly to a bracket portion of the mounting assembly such that an aperture defined in the clamp portion is aligned with an aperture defined in the bracket portion;

attaching the clamp portion of the mounting assembly to an extended segment of the window assembly attached to the evacuated enclosure such that a window located in the window assembly is aligned with the apertures of the clamp portion and the bracket portion; and attaching the bracket portion of the mounting assembly to a surface of the structure.

19. A method of joining an evacuated enclosure to a structure as defined in claim 18, wherein attaching the clamp portion of the mounting assembly to an extended segment further includes tightening the clamp portion about the extended segment such that the clamp portion frictionally engages the window assembly.

20. A method of joining an evacuated enclosure to a structure as defined in claim 19, wherein the clamp portion is an annular ring that defines the clamp portion aperture, the annular ring having a radial gap such that the annular ring defines a "C"-shaped configuration, and wherein the act of tightening the clamp portion about the extended segment further comprises the act of tightening a screw that passes through a screw hole defined through the gap such that the clamp portion aperture frictionally engages the window assembly.

21. A method of joining an evacuated enclosure to a structure as defined in claim 20, wherein the structure is an outer housing for containing the evacuated enclosure, and wherein the method further comprises:

after attaching the clamp portion of the mounting assembly to the bracket portion, inserting the evacuated enclosure within a volume defined by the outer housing.

22. A method of joining an evacuated enclosure to a structure as defined in claim 21, wherein attaching the bracket portion further includes:

attaching the bracket portion of the mounting assembly to a surface of the outer housing such that the bracket portion overlays an aperture defined in the surface of the outer housing.

23. An x-ray tube for use in an x-ray generating device, comprising:

an evacuated enclosure containing an electron source and a rotary anode positioned to receive electrons emitted by the electron source;

a window assembly attached about an aperture formed in the evacuated enclosure, comprising:

a hollow cylindrical segment hermetically attached about the aperture formed in the evacuated enclosure such that at least a protruding portion of the cylindrical segment extends beyond an outer surface of the evacuated enclosure; and an x-ray transmissive window positioned in the cylindrical segment;

an outer housing containing the evacuated enclosure, the outer housing having an aperture formed therein;

a mounting assembly configured to attach the x-ray tube to the x-ray generating device, comprising:

a clamp portion including an annular ring that defines an aperture, the annular ring having a radial cut through one portion thereof, the clamp portion aperture receiving and frictionally attaching to the protruding portion of the window assembly cylindrical segment such that the clamp portion aperture is aligned with the window; and a bracket portion having a substantially planar first surface, a curved second surface, and an aperture extending between the first and second surfaces, the bracket portion being affixed to an exterior portion of the outer housing such that the bracket portion aperture is positioned over the aperture of the outer housing, the bracket portion also being mechanically attached to the clamp portion such that the bracket portion aperture is aligned both with the clamp portion aperture and with the window, the bracket portion also being mechanically attached to a portion of the x-ray generating device such that the x-ray tube is fixed in a pre-determined position with respect to the x-ray generating device.

24. An x-ray tube as defined in claim 23, wherein the curved second surface of the bracket portion is concavely shaped to mate with the correspondingly shaped exterior portion of the outer housing.

25. An x-ray tube as defined in claim 24, wherein the clamp portion has a "C"-shaped configuration.

26. An x-ray tube as defined in claim 25, wherein the surface of the annular ring that defines the clamp portion aperture further defines an annular ridge, the protruding portion of the cylindrical segment seating against the ridge when the protruding portion is received into the aperture.

27. An x-ray tube as defined in claim 26, wherein the clamp portion includes a screw hole that passes across the radial cut, the screw hole being configured to receive a tightening screw therein.

28. An x-ray tube as defined in claim 27, wherein the curved second surface of the bracket portion further includes a circular recess for receiving a portion of the clamp portion therein.

29. An x-ray tube as defined in claim 28, wherein the circular recess of the bracket portion is concentric with the aperture of the bracket portion.

30. An x-ray tube as defined in claim 27, wherein the clamp portion extends inward through the aperture defined in the outer housing toward a central portion of the outer housing.

31. An x-ray tube as defined in claim 30, wherein the clamp portion, the bracket portion, and the x-ray generating device are mechanically attached using screws.

32. An x-ray generating device, comprising:

a device body; and an x-ray tube including:

an evacuated enclosure containing an electron source and a rotary anode positioned to receive electrons emitted by the electron source; and a mounting assembly that attaches the x-ray tube to the device body, including:

a bracket portion that mechanically attaches to a portion of the device body; and a clamp portion that frictionally engages a portion of the evacuated enclosure proximate an x-ray transmissive window that is located on a surface of the evacuated enclosure, wherein the clamp portion is also mechanically attached to the bracket portion such that the mounting assembly singularly supports the evacuated enclosure in a specified position with respect to the device body.

33. An x-ray generating device as defined in claim 32, wherein the x-ray generating device is a medical imaging device.

34. An x-ray generating device as defined in claim 33, wherein the portion of the device body to which the bracket portion mechanically attaches is a gantry of the medical imaging device.

35. An x-ray generating device as defined in claim 33, wherein the x-ray generating device is a mammography device.

36. An x-ray generating device as defined in claim 32, wherein the x-ray tube further comprises an outer housing containing the evacuated enclosure, and wherein the bracket portion of the mounting assembly also attaches to a portion of the outer housing.

37. An x-ray generating device as defined in claim 32, wherein the x-ray generating device is used for diagnostic testing of the x-ray tube.

* * * * *